US007578754B2

(12) United States Patent
Nakamura

(10) Patent No.: US 7,578,754 B2
(45) Date of Patent: Aug. 25, 2009

(54) IRON-TYPE GOLD CLUB HEAD

(75) Inventor: Takashi Nakamura, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 237 days.

(21) Appl. No.: 11/714,102

(22) Filed: Mar. 6, 2007

(65) Prior Publication Data

US 2007/0254749 A1 Nov. 1, 2007

(30) Foreign Application Priority Data

Apr. 26, 2006 (JP) ..... 2006-122418

(51) Int. Cl.
*A63B 53/04* (2006.01)

(52) U.S. Cl. ..... 473/342; 473/346; 473/349; 473/350

(58) Field of Classification Search ..... 473/324–350
See application file for complete search history.

(56) References Cited

U.S. PATENT DOCUMENTS

| | | | | | |
|---|---|---|---|---|---|
| 819,900 | A * | 5/1906 | Martin | 473/329 |
| 1,289,553 | A * | 12/1918 | Sanders | 473/331 |
| 2,034,936 | A * | 3/1936 | Barnhart | 473/329 |
| 3,970,236 | A * | 7/1976 | Rogers | 228/196 |
| 4,252,262 | A * | 2/1981 | Igarashi | 228/174 |
| 4,573,685 | A * | 3/1986 | Young et al. | 473/250 |
| 4,883,275 | A * | 11/1989 | Boone | 473/334 |
| 4,992,236 | A * | 2/1991 | Shira | 419/28 |
| 5,024,437 | A * | 6/1991 | Anderson | 473/342 |
| 5,346,213 | A * | 9/1994 | Yamada | 473/329 |
| 5,423,535 | A * | 6/1995 | Shaw et al. | 473/291 |
| 5,509,660 | A * | 4/1996 | Elmer | 473/288 |
| 6,099,414 | A * | 8/2000 | Kusano et al. | 473/342 |
| 6,443,857 | B1 * | 9/2002 | Chuang | 473/332 |
| 6,458,045 | B1 * | 10/2002 | Chen | 473/342 |

(Continued)

FOREIGN PATENT DOCUMENTS

JP 9-154986 A 6/1997

(Continued)

*Primary Examiner*—Sebastiano Passaniti
(74) *Attorney, Agent, or Firm*—Birch, Stewart, Kolasch & Birch, LLP

(57) ABSTRACT

An iron-type golf club head 1 having top 3, sole 4, and toe 4 connecting the top and the sole on the toe side, and comprising a face plate 7 forming at least a part of a club face 2 and a head body 8 to which the face plate is attached; wherein the face plate 7 is made from a metal material formed by forging or rolling and the head body 8 is made from a metal material having a larger specific gravity than the face plate, and wherein the face plate 7 has upper (top side) edge surface 11, lower (sole side) edge surface 12 and outer peripheral edge surface 10 including toe side edge surface 13 connecting the upper and lower edge surfaces 11 and 12, and at least a part of the upper edge surface 11 is exposed to the top 3 to constitute a part of the top as an upper exposed portion 15, and the upper exposed portion 15 is welded to the head body at the top face. The club head has a low center of gravity and the ball controllability is improved.

8 Claims, 10 Drawing Sheets

U.S. PATENT DOCUMENTS

| | | | | |
|---|---|---|---|---|
| 6,506,129 | B2 * | 1/2003 | Chen | 473/329 |
| 6,746,342 | B1 * | 6/2004 | Hsieh | 473/342 |
| 6,814,674 | B2 * | 11/2004 | Clausen et al. | 473/342 |
| 6,923,733 | B2 * | 8/2005 | Chen | 473/305 |
| 7,121,958 | B2 * | 10/2006 | Cheng et al. | 473/345 |
| 7,258,628 | B2 * | 8/2007 | Huang et al. | 473/342 |
| 2002/0115504 | A1 * | 8/2002 | Chen | 473/342 |
| 2003/0054901 | A1 * | 3/2003 | Sun | 473/342 |
| 2005/0107183 | A1 * | 5/2005 | Takeda et al. | 473/326 |
| 2006/0073912 | A1 * | 4/2006 | Hsieh et al. | 473/350 |
| 2006/0135285 | A1 * | 6/2006 | Hou et al. | 473/342 |
| 2006/0293119 | A1 * | 12/2006 | Hou | 473/342 |
| 2007/0026965 | A1 * | 2/2007 | Huang | 473/342 |

FOREIGN PATENT DOCUMENTS

| | | |
|---|---|---|
| JP | 09-154987 | 6/1997 |
| JP | 2001-161870 | 6/2001 |
| JP | 2002-186696 | 7/2002 |
| JP | 3093707 | 2/2003 |
| JP | 2003-126313 | 5/2003 |
| JP | 2005-325387 | 11/2005 |

* cited by examiner

IRON-TYPE GOLD CLUB HEAD

BACKGROUND OF THE INVENTION

The present invention relates to an iron-type golf club head formed by welding a face plate and a head body together, and more particularly to an iron-type golf club head having the center of gravity at a low position of the head.

In recent years, as disclosed for example in JP-A-9-154986, there is proposed an iron-type golf club head "c", as shown in FIGS. 12(*a*) and 12(*b*), wherein in order to move the center of gravity toward the bottom and back of the club head, a face plate "a" having a small specific gravity is fixed to a head body "b" having a larger specific gravity than the face plate "a".

However, since in this sort of the iron-type golf club head the face plate "a" and the head body "b" are welded together on a hitting face "f", an upper side edge surface al of the face plate "a" is covered with a blade b1 on a top side of the head body "b" which has a larger specific gravity than the face plate "a". As a result, the weight of an upper portion of the head is not sufficiently decreased, so there is a limit in moving the center of gravity toward the bottom. Therefore, there is room for improvement in ball controllability (e.g., performances to lift a ball more easily and to stop the ball more easily after falling) which has been strongly demanded for iron-type golf club heads.

It is an object of the present invention to provide an iron-type golf club head having the center of gravity at a low position of the head and accordingly having an improved controllability of golf balls.

This and other objects of the present invention will become apparent from the description hereinafter.

SUMMARY OF THE INVENTION

It has been found that the above object can be achieved by providing an upper side edge surface of the face plate with an upper exposed portion which constitutes a part of the top of the golf club head and by welding the face plate to the head body so that the exposed portion forms the top face of the golf club head together with an upper side edge surface of the head body.

In accordance with the present invention, there is provided an iron-type golf club head having a top forming an upper surface of the club head, a sole forming a bottom surface of the club head, and a toe connecting the top and the sole on a toe side of the club head, and comprising, at least, a face plate whose front surface forms at least a part of a face for hitting a golf ball, and a head body to which the face plate is attached, wherein the face plate is made from a metal material formed by forging or rolling, and the head body is made from a metal material weldable with the face plate and having a larger specific gravity than the face plate, and wherein the face plate has an upper edge surface located on the top side, a lower edge surface located on the sole side, and an outer peripheral edge surface including a toe side edge surface connecting the upper edge surface and the lower edge surface, and the face plate is welded to the head body and extends to the top so that at least a part of the upper edge surface includes an upper exposed portion which constitutes a part of the top face.

The iron-type golf club head of the present invention includes a face plate welded to a head body so that the upper edge surface of the face plate is exposed and constitutes a part of the top of the head. Since such an upper exposed portion of the face plate is not covered with the head body which has a higher specific gravity, the weight of an upper portion of the club head can be effectively decreased. Therefore, the position of the center of gravity of the club head can be lowered and, consequently, the controllability of golf balls is improved.

The upper exposed portion of the face plate is welded to the head body at the top face of the club head. Since the welding is applied to the top which has little chance of contacting the ground and golf balls, the durability of the club head can be improved.

BRIEF DESCRIPTION OF THE DRAWINGS

FIG. 12(*b*) is a cross sectional view along the line A-A of FIG. 12(*a*).

DETAILED DESCRIPTION OF THE INVENTION

Figure 1:
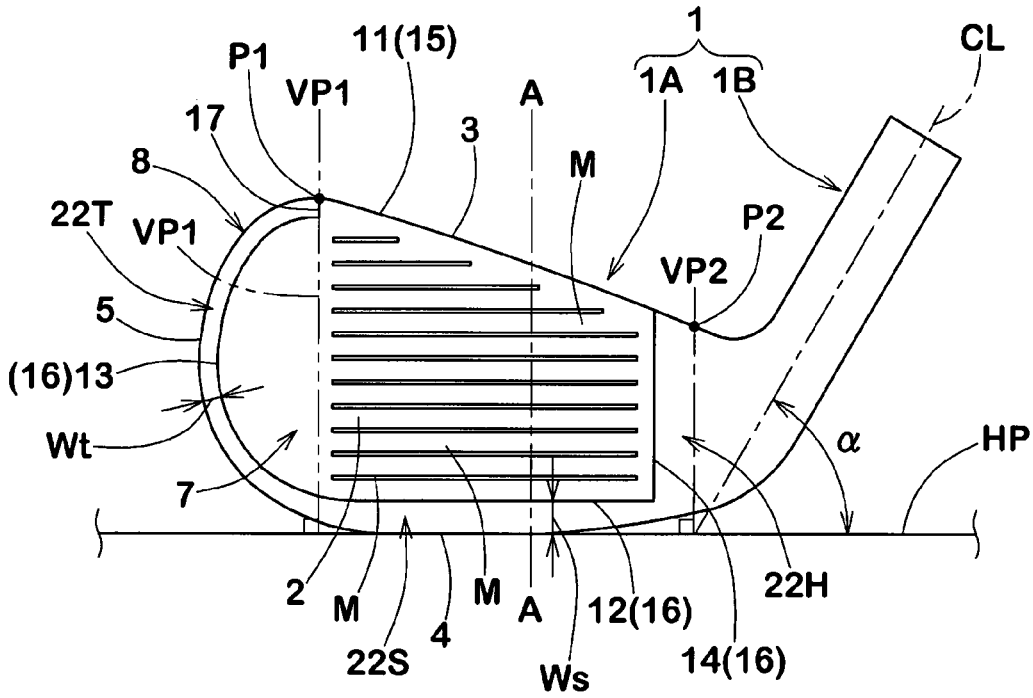
FIG. 1 is a front view of an iron-type golf club head in the standard state according to an embodiment of the present invention.
Figure 2:
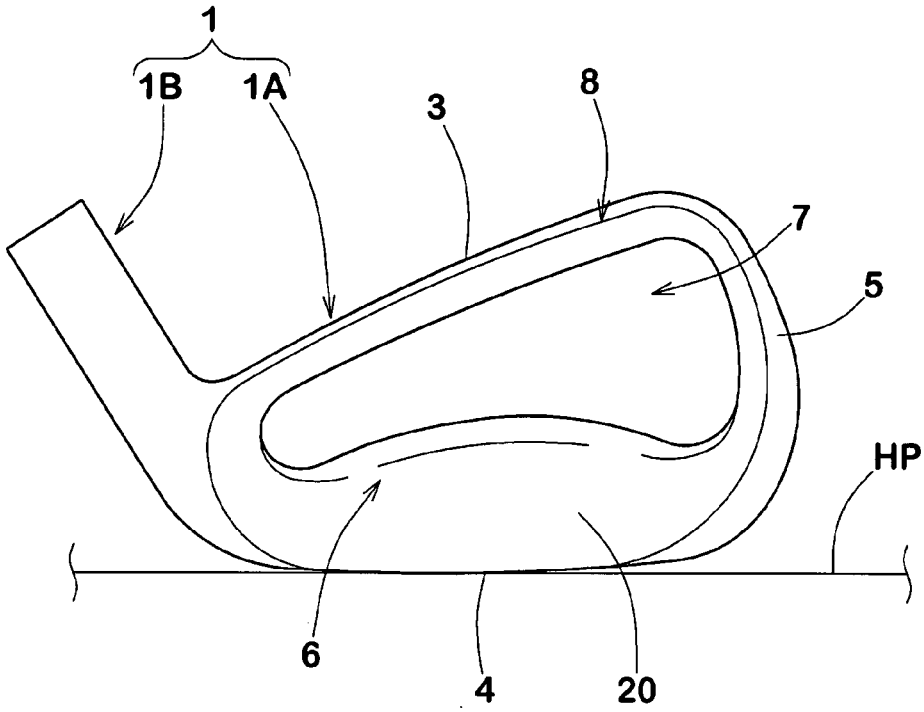
FIG. 2 is a back view of the club head of FIG. 1.

An embodiment of the present invention will now be explained with reference to the accompanying drawings.

FIGS. 1 to 5 show an iron-type golf club head 1 according to an embodiment of the present invention. In these drawings, the club head 1 is placed in the standard state. The term "standard state" as used herein denotes the state that the club head 1 is placed on a horizontal plane HP with keeping prescribed lie angle a and loft angle (real loft angle) β. The sizes and directions of respective portions of the club head 1 denote those measured in the standard state unless otherwise noted. For example, with respect to the club head 1, the up-and-down direction and the terms "high" and "low" denotes those of the club head 1 in the standard state. Further, the front-and-rear direction or the terms "front" and "rear (or back)" denote that face 2 side is the front and back face side is the rear. In the case that a shaft is not attached, the center line CL of a shaft inserting hole of a hosel 1B is used, instead of the axis of the club shaft, as a basis to determine the lie angle a.

The club head 1 comprises a face base portion 1A which has a club face 2 for hitting a golf ball on the front side and provides a main portion of the head, and a hosel portion 1B which is provided on the heel side of the face base portion 1A and to which a shaft (not shown) is attached.

The face base portion 1A comprises a club face 2, a top 3 which intersects with the face 2 at its upper edge and forms the upper surface of the head 1, a sole 4 which intersects with the face 2 at its lower edge and forms the bottom surface of the head 1, a toe 5 connecting the top 3 and the sole 4 on the toe side, and a back face 6 which is a face on the side opposite to the face 2. The faces of top 3, sole 4, toe 5 and back 6 are exposed to the outside as an outer surface of the head 1.

The face 2 in this embodiment is provided with an impact area marking M in order to increase the friction with a ball. The impact area marking M includes, for instance, grooves and/or punch mark such as small dot-like dents, as described in the Rule of Golf established by Japan Golf Association, Section II of Additional Rule, Paragraph 5 "Club Face". In this embodiment, a plurality of grooves which substantially horizontally extend in the toe-and-heel direction are provided as an impact area marking M on the face 2. The face 2 is formed substantially by a single plane, excepting the impact area marking M.

The face 2 includes a toe side point P1 located at the highest position of the upper edge of the face, and a heel side point P2 located at the lowest position of the upper edge of the face. These points P1 and P2 are located on the above-mentioned single plane. A plane passing through the toe side point P1 and vertical to the face 2 is referred to as a toe side vertical plane VP1, and a plane passing through the heel side point P2 and vertical to the face 2 is referred to as a heel side vertical plane VP2.

The top 3 is defined as an upper surface portion of the head 1 which extends between the toe side vertical plane VP1 and the heel side vertical plane VP2, and it extends almost linearly while inclining downwardly from the toe toward the heel. The sole 4 is defined as an bottom surface portion of the head 1 which extends between the toe side vertical plane VP1 and the heel side vertical plane VP2, and the greater part of the sole extends almost horizontally in the toe-and-heel direction. The toe 5 is defined as an edge surface portion located on the toe side with respect to the toe side vertical plane VP1. The toe 5 shown in this embodiment is smoothly curved in an arc-like form convex toward the outside.

Figure 4:
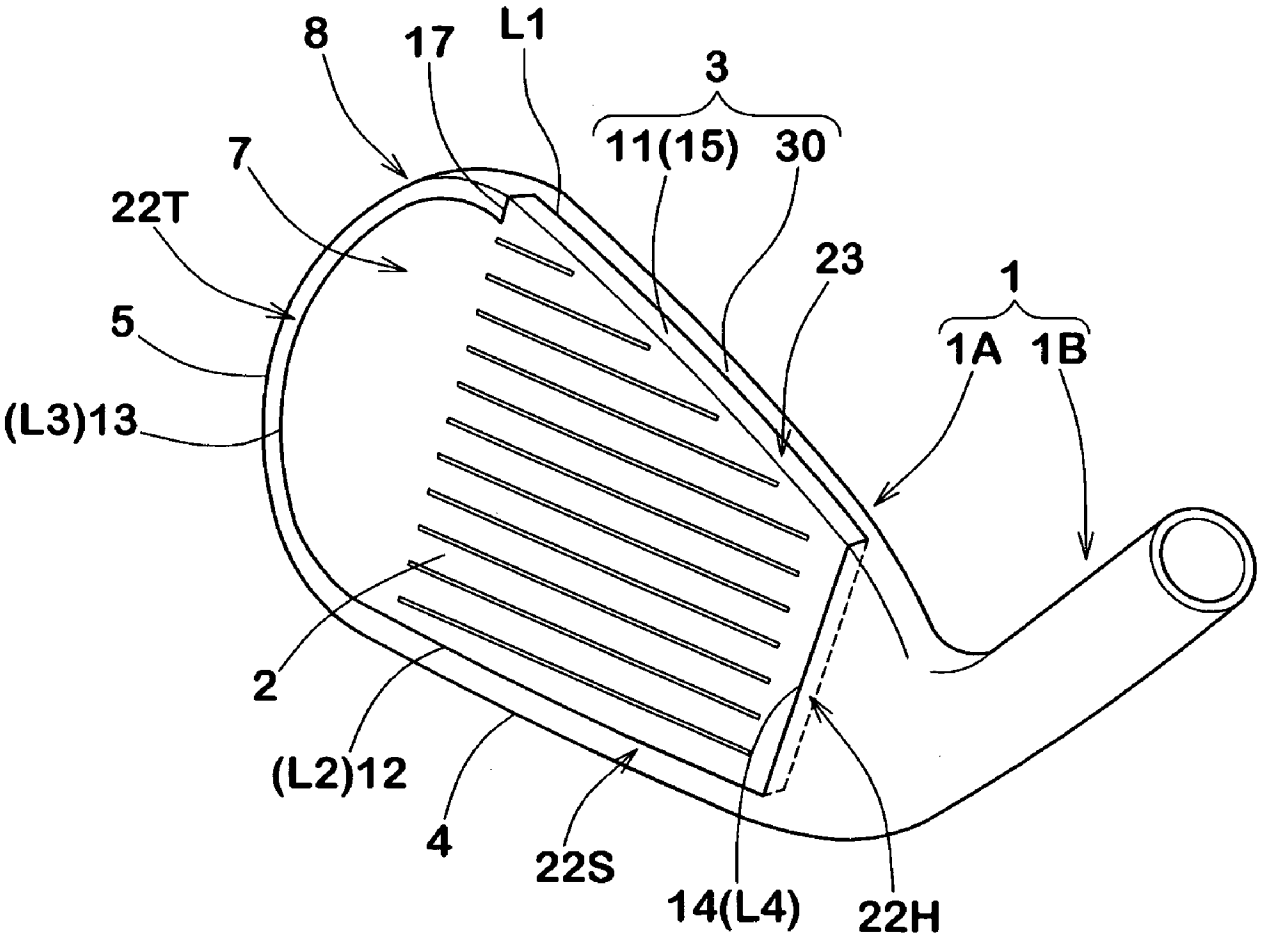
FIG. 4 is a perspective view of the club head of FIG. 1.
Figure 5:
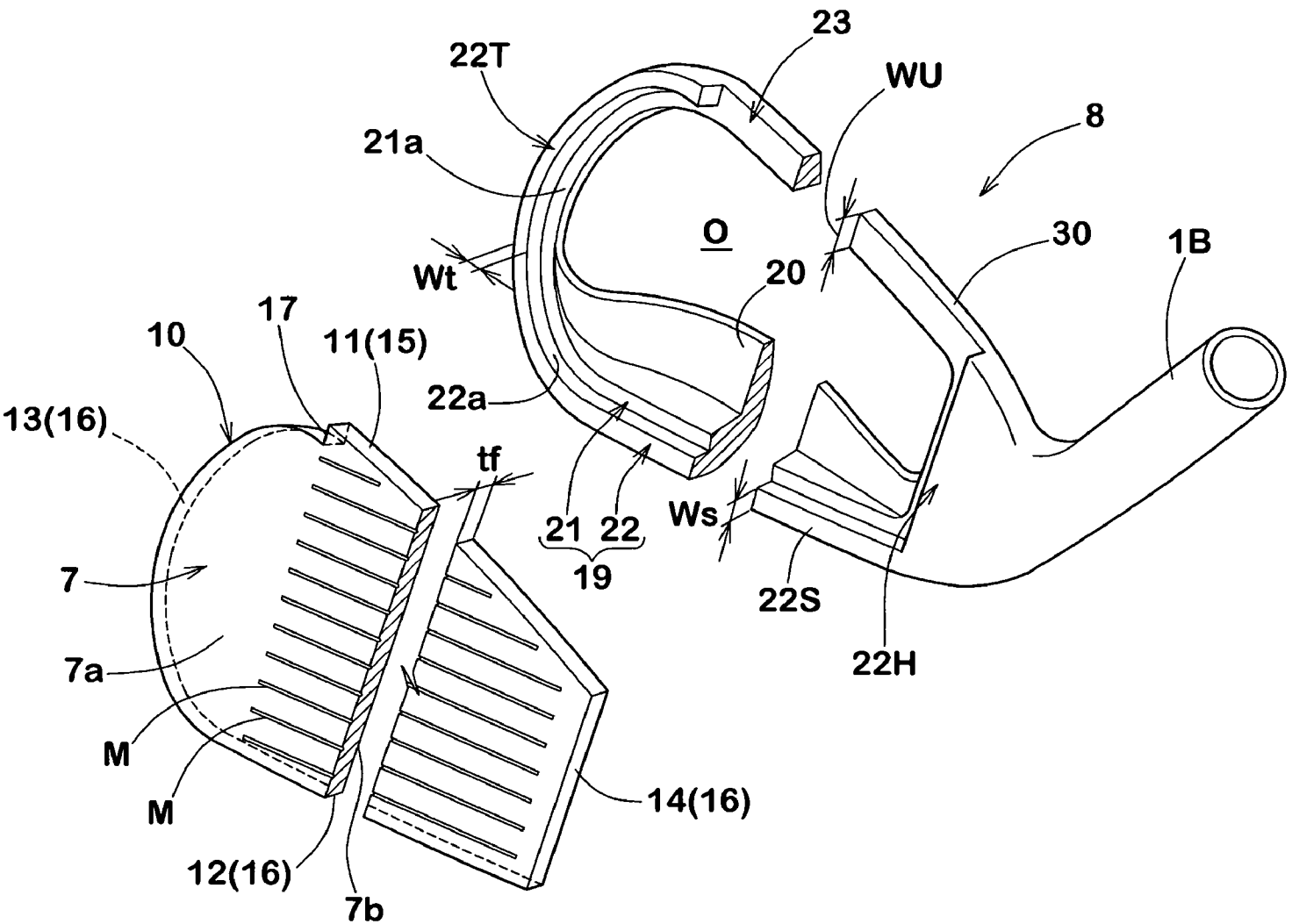
FIG. 5 is an exploded view of the club head shown in FIG. 4.

The club head 1 includes, as shown in FIG. 5, a face plate 7 forming at least a part of the face 2, and a head body 8. In this embodiment as shown in FIGS. 1 to 5, the club head 1 is formed from these two members 7 and 8. The face plate 7 is formed from a metal material formed by forging or rolling. The head body 8 is formed from a metal material which is weldable with the face plate 7 and has a higher specific gravity than the face plate 7.

The term "forging" as used herein encompasses all plastic working methods to obtain a desired shape with beating out or thinning a massive material by a hammer and/or a press mold. The forging includes, for instance, cold forging which is carried out at room temperature, warm forging which is carried out by heating a material to be processed to a temperature lower than the recrystallization temperature of the material, and hot forging which is carried out by heating a material to be processed to a temperature not lower than the recrystallization temperature of the material.

The term "rolling" as used herein encompasses all processing methods to reduce the thickness or the cross sectional area by causing a pair of rotating rolls to bite a material to be processed and passing between the rolls. The rolling includes, for instance, cold rolling which is carried out at room temperature, and hot rolling which is carried out at elevated temperatures.

The phrase "being formed by forging or rolling" encompasses, to say nothing, not only an embodiment wherein forming is conducted only by forging or rolling processing, but also an embodiment wherein a mechanical processing such as pressing or punching is carried out before or after the forging or rolling step, and a heat treatment step or the like is further carried out as occasion demands.

If a plastic deformation is added to a metal material by forging and/or rolling, the strength and toughness are enhanced by work hardening of the material. Further, since these processing methods do not form ingot piping as formed in casting, the mechanical properties of the material can be made uniform and the strength can be enhanced. Further, use of a material formed by forging or rolling in the face plate 7 provides a softer ball hitting feel as compared with a cast material. From such points of view, a face plate 7 formed by forging or rolling is used in the present invention.

The metal material constituting the face plate 7 is not particularly limited so long as it is one formed by forging or rolling as mentioned above. However, in order to effectively exhibit the effect of improving the ball hitting feel of forging or rolling, it is preferable to use Fe—Al alloys containing at least 50% by weight of Fe and 5 to 15% by weight of Al as a material of the face plate 7. Such Fe—Al alloys can exhibit an excellent damping effect, since the domain wall in the material moves when an external force is applied to the material, and the applied force (energy) is converted to heat and is released to the outside as a heat. Therefore, since vibration of the face plate 7 generated when hitting a ball is effectively damped, vibration conveyed to hands of golf player is markedly decreased, whereby is obtained a ball hitting feel identical to or superior to that obtained by a so-called soft iron (carbon steel) which is popular as a material capable of providing a soft and good hitting feel.

The Fe—Al alloys can possess a specific gravity within the range of approximately 6.6 to 7.2. Since the specific gravity within this range is smaller than that of a low carbon steel (about 7.8) such as soft iron, it is possible, for example, by combining head body 8 made of a soft iron, to lighten the club head 1, to lower the center of gravity, and/or to increase the area of the face 2 with keeping the weight of club head.

If the aluminum content in the Fe—Al alloys is less than 5% by weight, the specific gravity of the alloys tends to increase and, therefore, it is prevented to lower the center of gravity. If the aluminum content is more than 15% by weight, the processability of the alloys tend to be deteriorated. From such points of view, the Al content in the alloys is preferably at least 7% by weight, more preferably at least 8% by weight, and is preferably at most 14% by weight, more preferably at most 12% by weight. Further, if the iron content in the Fe—Al alloys is less than 50% by weight, the weldability with other iron alloys and carbon steel is which are suitably used as a material of the head body 8 is deteriorated, thus resulting in lowering of productivity.

The Fe—Al alloys can contain, besides Fe, Al and unavoidable impurities, other metals such as Mn, Cr, C, Si and a mixture of at least two of them. Preferable examples of the Fe—Al alloys are shown in Table 1.

TABLE 1

| | Ingredients (% by weight) | | | | | |
|---|---|---|---|---|---|---|
| | C | Mn | Al | Cr | Si | Fe |
| Alloy A | 0.5 | 20 | 10 | — | — | residue |
| Alloy B | 0.9-1.2 | 26-29 | 8.0-9.5 | 2.6-3.2 | <0.2 | residue |
| Alloy C | 1.0-1.4 | 20-35 | 10-12 | 2.0-4.5 | — | residue |
| Alloy D | <0.01 | <0.2 | 7.5-8.5 | <0.2 | <0.2 | residue |

(Note)
The "residue" contains unavoidable impurities.

As shown in FIG. 5, the face plate 7 includes a front face 7*a*, a back face 7*b* opposite to the front face, and an outer peripheral edge surface 10 which connects the front and back faces 7*a* and 7*b* and annularly extends. The face plate 7 of this embodiment as shown in FIGS. 1 to 5 has substantially a constant thickness. Therefore, the annularly and continuously extending outer peripheral surface 10 has substantially a constant width. However, the thickness of the face plate 7 can be suitably changed according to a usual practice. For example, for the purpose of enhancing the repellency of the head with keeping the strength, the face plate 7 may be formed so that a central portion is thick and a peripheral portion is thin, or vice versa.

The thickness tf of the face plate 7 is not particularly limited. However, if the thickness tf is too small, the durability of the face plate 7 tends to lower for lack of strength, and if the thickness tf is too large, the weight of the face plate 7 increases and, therefore, there is a possibility that it becomes difficult to sufficiently lower the center of gravity because of decrease in weight margin utilizable for weight distribution design. From such points of view, the thickness tf of the face plate 7 is preferably at least 1.5 mm, more preferably at least 2.0 mm, and is preferably at most 4.0 mm, more preferably at most 3.5 mm.

The front face 7*a* is formed into substantially a single plane, excepting the impact area marking M.

The outer peripheral edge surface 10 includes an upper edge surface 11 which is located on the top 3 side and extends between the toe side vertical plane VP1 and the heel side vertical plane VP2, a lower edge surface 12 which is located on the sole 4 side and extends between the toe side vertical plane VP1 and the heel side vertical plane VP2, a toe side edge surface 13 which connects the upper edge surface 11 and the lower edge surface 12 on the toe 5 side, and a heel side edge surface 14 which connects the upper edge surface 11 and the lower edge surface 12 on the heel side.

At least a part of the upper edge surface 11 of the face plate 7 is exposed to the outside to provide an upper exposed portion 15 and constitutes a part of the top face 3. In this embodiment shown in the figures, substantially the whole area of the upper edge surface 11 provides the upper exposed portion 15.

On the other hand, in this embodiment, the lower edge surface 12 of the face plate 7 almost horizontally extends in the toe-and-heel direction over its whole area above the sole face 4 without contacting the sole face 4. Thus, the whole of the lower edge surface 12 is formed as a non-exposed portion 16 which does not appear on the outer surface of the head at the sole 4.

Further, in this embodiment, the face plate 7 has such a shape that the toe side edge surface 13 does not contact the toe face 5 in its whole area. The toe side edge surface 13 extends in almost an arc-like form along the toe face 5 at a location inside the toe face 5 (on the heel side with respect to the toe face 5). Thus, the toe side edge surface 13 is also formed as a non-exposed portion 16 which does not appear on the outer surface of the head at the toe 5. The toe side edge surface 13 is connected to the upper edge surface 11 through a joint face 17 extending up and down as a step as shown in FIG. 5.

Further, in this embodiment, the heel side edge surface 14 of the face plate 7 vertically extends at a location inside the heel side vertical plane VP2 (on the toe side with respect to the vertical plane VP2) to connect the upper and lower edge surfaces 11 and 12. The heel side edge surface 14 is also formed as a non-exposed portion 16 which does not appear on the outer surface of the head.

The head body 8 is formed from, for example, a low carbon steel having a carbon content of less than 0.8% by weight, preferably less than 0.5% by weight, more preferably less than 0.3% by weight. Such a low carbon steel encompasses a so-called soft iron and, in particular, a carbon steel for mechanical structure such as S25C, S20C, S15C or S10C is preferred. Such a soft iron provides a good welded joint when welded to a face plate 7 made of a Fe—Al alloy and, also, exhibits an impact-absorbing property. Further, since the specific gravity of the low carbon steel falls within the range of about 7.8 to about 7.9, the head body 8 can possess a larger specific gravity than the face plate 7 made of a Fe—Al alloy. Therefore, the use of the low carbon steel as mentioned above is effective for moving the center of gravity toward the bottom and back of the club head.

In this embodiment, the head body 8 is provided with an opening O which passes through back and forth, and it comprises a face mount portion 19 for attaching the face plate 7 thereto which is provided in the periphery of the opening O, a back wall portion 20 which is provided behind the face mount portion 19 and is capable of forming a cavity C in a pocket form between it and the back face of the face plate 7, and a hosel 1B. Such a frame-like head body 8 having an opening O provides the club with a larger moment of inertia since the weight is distributed to the periphery of and behind the face plate 7 and, therefore, serves to improve the direction performance of hit ball. Such a head body 8 can be produced by various methods, but forging is preferred since a good ball hitting feel is obtained.

The face mount portion 19 is composed of a receiving portion 21 having a receiving face 21*a* which is located behind the club face 2 and supports a peripheral edge portion of the back face 7*b* of the face plate 7, and an outer wall portion 22 having an internal circumference wall 22*a* which rises from the peripheral edge of the receiving portion 21 and supports the outer peripheral edge surface 10 of the face plate 7.

The receiving portion 21 is formed into a continuous annular form to surround the opening O, whereby the peripheral edge portion of the back face 7*b* of the face plate 7 is annually and continuously supported, thus improving the fitting strength for the face plate. The width WU (measured from the edge of the opening O in the direction perpendicular to the edge) of the receiving portion 21 is not particularly limited. However, if the width WU is too small, the bonding strength of the face plate 7 is lowered, and if the width WU is too large, the weight of the club head 1 increases and therefore the weight margin utilizable for weight distribution design is decreased. From such points of view, the width WU of the receiving portion 21 is preferably at least 2 mm, more preferably at least 3 mm, and is preferably at most 8 mm, more preferably at most 6 mm.

As shown in FIGS. 1 and 5, the outer wall portion 22 is composed of a sole side outer wall portion 22S which extends between the toe side vertical plane VP1 and the heel side vertical plane VP2, a toe side outer wall portion 22T which is continuous with the sole side outer wall portion 22S and is located on the toe side with respect to the toe side vertical plane VP1, and a heel side outer wall portion 22H which extends upward from the end on the heel side of the sole side outer wall portion 22S. The height of the internal circumference wall 22*a* from the receiving face 21*a* is substantially identical with the thickness tf of the face plate 7 (width of the outer peripheral edge surface 10), so the outer wall portion 22 forms a single plane with the front face of the face plate 7 when the face plate 7 is attached to the face mount portion 19.

It is preferable that the outer wall portion 22 supports the face plate 7 so as to continuously surround at least 60%, especially at least 65%, of the full length of the outer peripheral edge surface 10, whereby positioning of the face plate 7 is properly achieved when the face plate 7 is set in the face mount portion 19. In particular, movement of the face plate 7 in the up-and-down and light-and-left directions can be restricted by the heel side outer wall portion 22H extending up and down and the toe side outer wall portion 22T which is opposite thereto and extends in an arc form protruding toward the toe side. Therefore, mispositioning of the both members prior to and at the time of welding can be effectively prevented, so the both member can be welded in good accuracy and the productivity is significantly improved.

The outer wall portion 22 is provided, at-its upper portion, with an upper broken portion 23 for causing the upper exposed portion 15 of the face plate 7 to expose on the top 3. The upper broken portion is a portion which has been removed from the outer wall portion 22 on its top 3 side between the toe side and heel side vertical planes VP1 and VP2 in a length corresponding to the length of the upper exposed portion 15. At the upper broken portion 23, the receiving portion 21 extends up to the top 3, and upper edge surface 30 of the receiving portion 21 forms a rear portion of the top 3 while the upper edge surface 11 (exposed portion 15) of the face plate 7 forms a front portion of the top 3.

As shown in FIG. 4, in the state that the head body 8 and the face plate 7 are temporarily assembled by setting the head body 8 in the face mount portion 19, the upper exposed portion 15 of the face plate 7 forms the front portion of the top 3, and the upper edge surface 30 of the head body 8 forms the rear portion of the top 3. Welding is performed along a boundary line L1 between the front and rear portions of the top. That is to say, at the top 3, the head body 8 and the exposed portion 15 of the face plate 7 are integrally fixed by filling a molten metal in a space between the head body 8 and the exposed portion 15, or by irradiating a heat energy such as laser beams to the neighborhood of the boundary line L1. Welding between the joint face 17 and the head body 8 can be conducted on the face 2.

In golf club head 1 as mentioned above, the face plate 7 having a lower specific gravity than the head body 8 constitutes a part (front portion) of the top 3, and the upper portion of the face plate is not covered with the head body 8 which has a higher specific gravity. Therefore, the weight of an upper portion of the club head can be effectively decreased. Therefore, the position of the center of gravity of the club head can be lowered. Further, in a usual use of golf club, the top 3 has little chance of contacting the ground. Therefore, by providing a welded portion on such a location, contact of the welded portion with the ground and balls can be suppressed. Thus, fatigue destruction and the like of the welded portion can be prevented over a long term, so the durability of the club head can be improved.

The upper exposed portion 15 is not required to be formed in a full region of the upper edge surface 11 of the face plate 7. However, if the proportion of the exposed portion 15 in the upper edge surface 11 is too small, there is a possibility that lowering of the center of gravity of the club head 1 is not sufficiently realized. Therefore, it is preferable that the upper exposed portion 15 occupies at least 60%, especially at least 65%, more especially at least 70%, of the upper edge surface 11 defined by the toe side and heel side vertical planes VP1 and VP2.

The lower edge surface 12 of the face place 7 is supported by the internal circumference wall 22*a* of the sole side outer wall portion 22. Welding is applied onto the face 2 along a boundary line L2 between the front edge of the lower edge surface 12 and the sole side outer wall surface 22S.

Club head 1 of this type is useful in increasing the weight of the bottom portion of the head, thereby moving the center of gravity toward the bottom, since a part of the head body 8 having a larger specific gravity (namely sole size outer wall portion 22S) is located below the lower edge surface 12 of the face plate 7. Further, the club head 1 does not have a welded portion on the sole 4. The sole 4 frequently contacts the ground at the time of swing and receive a large impact every contact. If the sole side of the face plate is welded to the head body by applying welding onto the sole face 4, the welded portion frequently contacts the ground every swing, resulting in fatigue destruction of the welded portion. However, since in this embodiment the club head 1 does not have a welded portion on the sole 4, the durability of the club head can be maintained.

The toe side edge surface 13 of the face plate 7 is supported by the internal circumference wall 22*a* of the toe side outer wall portion 22T. Welding is performed along a boundary line L3 between the front edge of the toe side edge surface 13 and the toe side outer wall portion 22T, whereby the weight of the head body 8 can be distributed to the toe side in a good balance.

Similarly, the heel side edge surface 14 of the face plate 7 is supported by the internal circumference wall 22*a* of the heel side outer wall portion 22H, and welding is performed along a boundary line L4 between the front edge of the heel side edge surface 14 and the heel side outer wall portion 22H.

Welding between the face plate 7 and the head body 8 can be performed by various methods and, for example, laser welding, plasma welding and TIG welding are preferable. Laser welding which provides a weld bead with a small width is particularly preferable.

In the embodiment mentioned above, as shown in FIGS. 1 and 5, it is preferable to form the sole side outer wall portion 22S to have a width Ws larger than the width Wt of the toe side outer wall portion 22T, whereby a larger portion of the weight can be distributed to a bottom portion of the head so as to further lower the center of gravity. Each width Ws or Wt is measured on the face 2 from the outer peripheral edge surface 10 in right-angle direction. In case that the width varies, the width is represented by a weighted average value. It is preferable that the Ws/Wt ratio is at least 1.2, especially at least 1.5. If the Ws/Wt ratio is too large, there is a possibility that the strength of the toe side outer wall portion 22T is lowered and, therefore, the Ws/Wt ratio is preferably at most 2.0.

Figure 3:
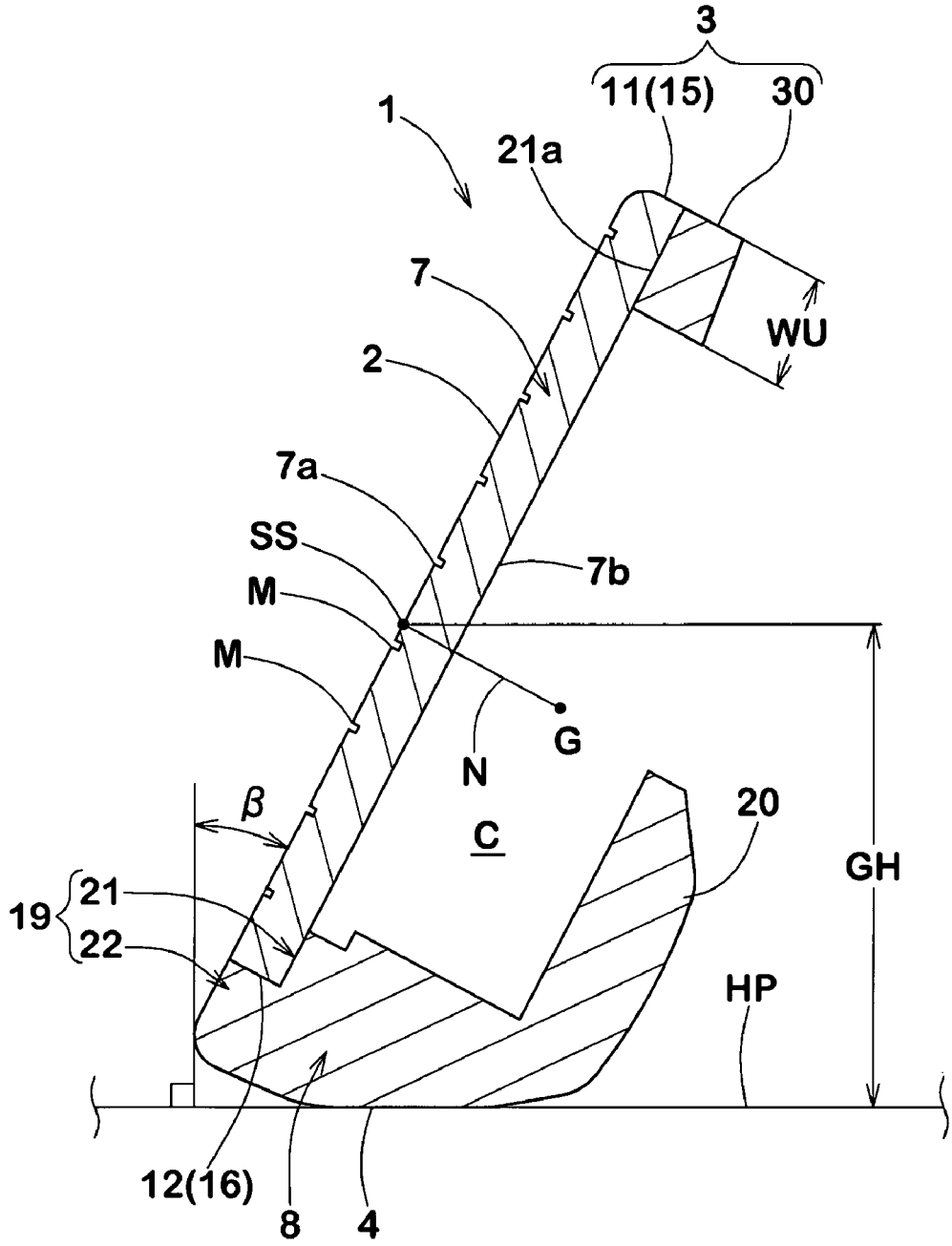
FIG. 3 is an enlarged cross sectional view along the line A-A of FIG. 1.

Iron-type golf club head 1 constituted as mentioned above has the center G of gravity at a low position, as shown in FIG. 3. Preferably, the height GH of the center of gravity which is defined as a height from the horizontal plane HP of the sweet spot SS which is a point where a normal line N drawn to the club face 2 from the center G of gravity of the club head 1 intersects the club face 2, is at most 21.0 mm, especially at most 20.0 mm, more especially at most 19.5 mm. The lower the height GH of the center of gravity, the better and, therefore, the lower limit thereof is not particularly limited. However, in practical use, the height GH is preferably at least 15.0 mm.

A region on the face 2 between the toe side and heel side vertical planes VP1 and VP2, and so on, may be subjected to a surface treatment such as sand blasting in order to render a weld between the joint face 17 and the head body 8 visually inconspicuous.

Figure 6:
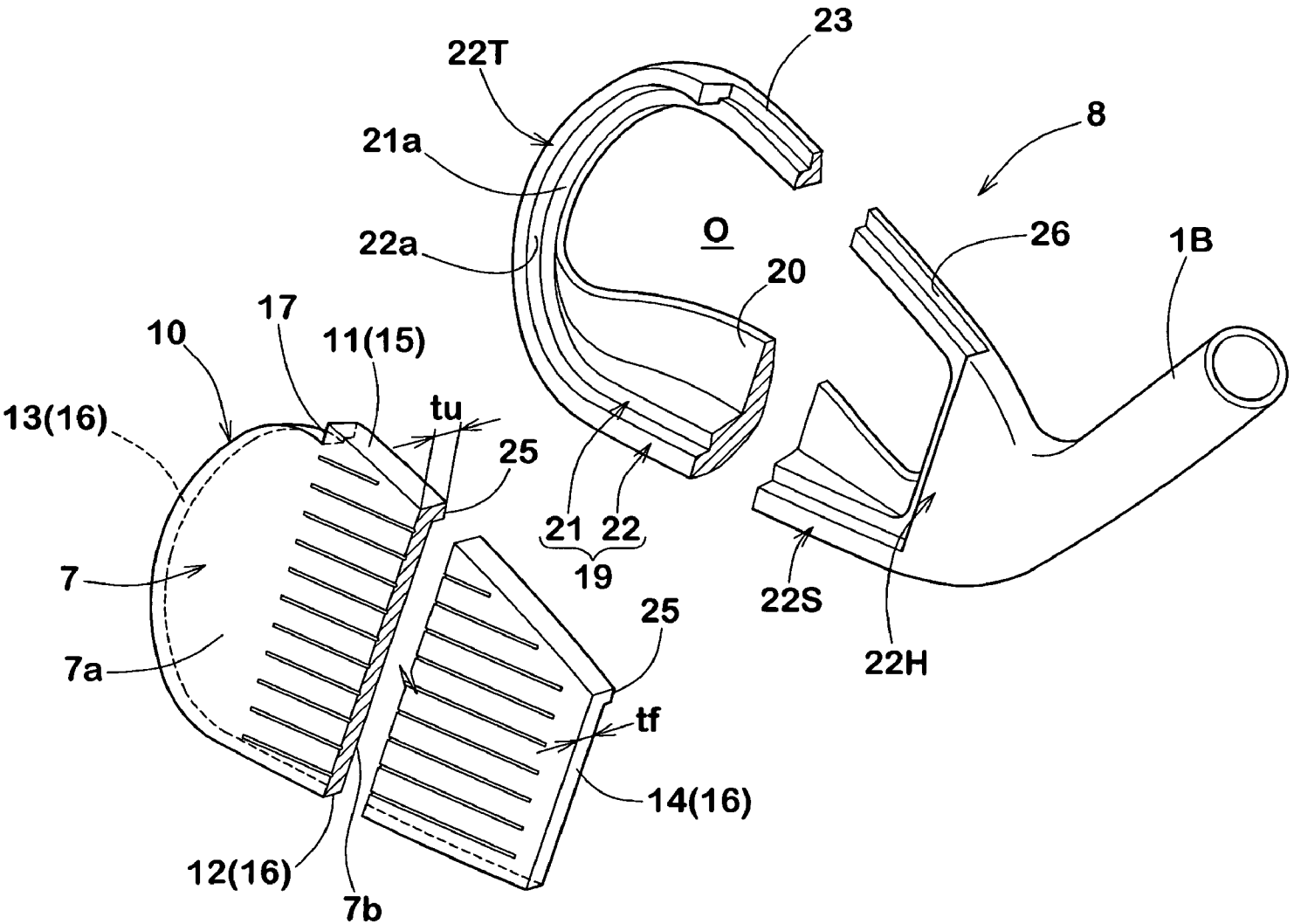
FIG. 6 is a front view of an iron-type golf club head showing another embodiment of the present invention.

FIG. 6 shows another embodiment of the present invention, in which the face plate 7 is provided with a rib 25 which extends along the upper edge surface 11 of the face plate 7 and projects toward the back. The rib 25 is formed so that the width "tu" of the upper edge surface 11 of the face plate 7 (i.e., width of the upper exposed portion 15) is larger than the width "tf" of the other edge surfaces. In other words, the thickness "tu" of the rib 25 is larger than the thickness "tf" of the remaining portions of the face plate. On the other hand, a dent portion 26 for setting the rib 25 therein is provided in the receiving face 21*a* at a location corresponding to the upper broken portion 23 of the head body 8.

The golf club head 1 according to such an embodiment can further decrease the proportion occupied by the head body 8 while further increasing the proportion of the face plate 7 on the top 3 side. Therefore, it is possible to move the center of gravity to a lower position. Further, positioning between the face plate 7 and the head body 8 can be performed with better accuracy by engagement of the rib 25 and the dent portion 26.

Figure 7:
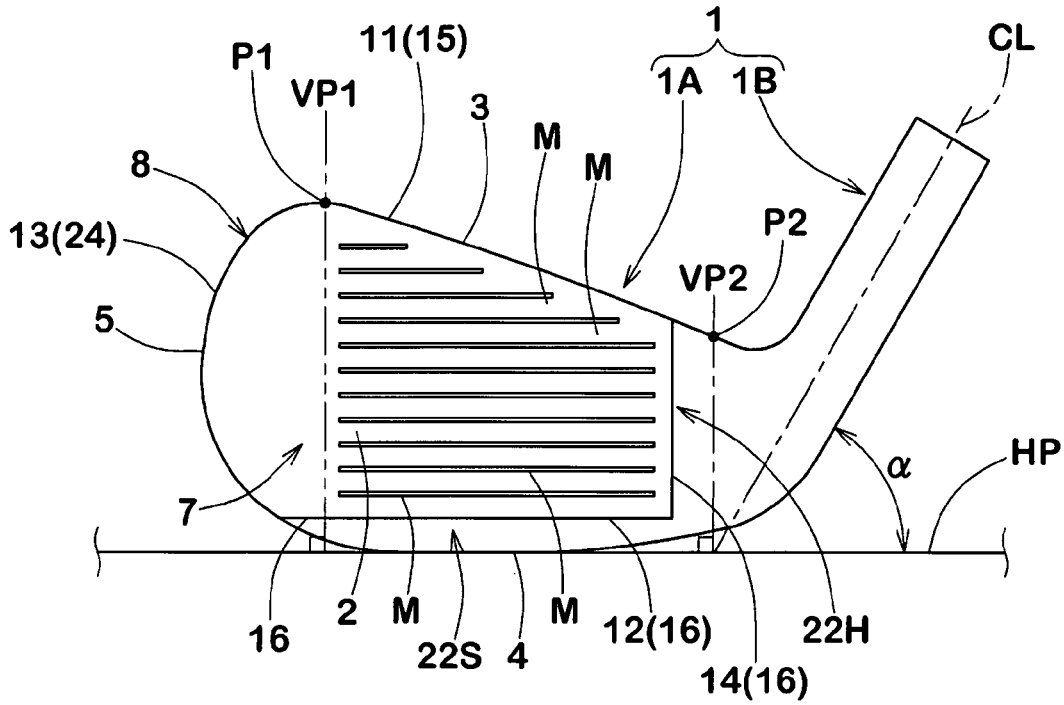
FIG. 7 is a front view of an iron-type golf club head showing still another embodiment of the present invention.
Figure 8:
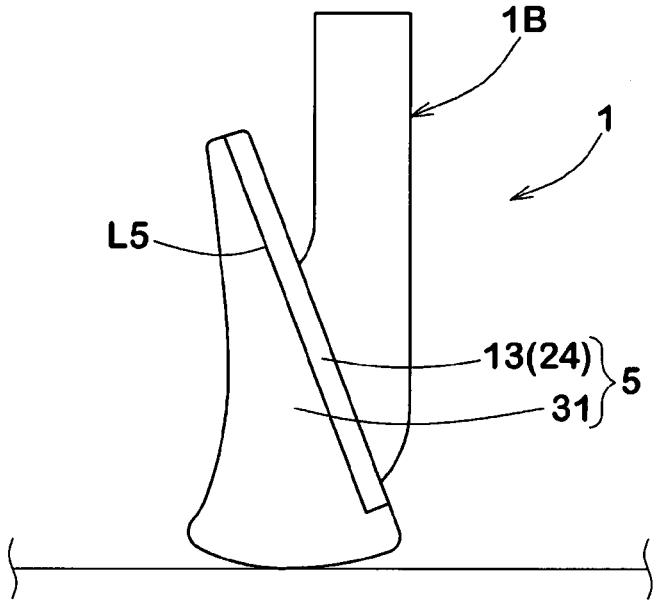
FIG. 8 is a side view of the club head of FIG. 7 viewed from the toe side.
Figure 9:
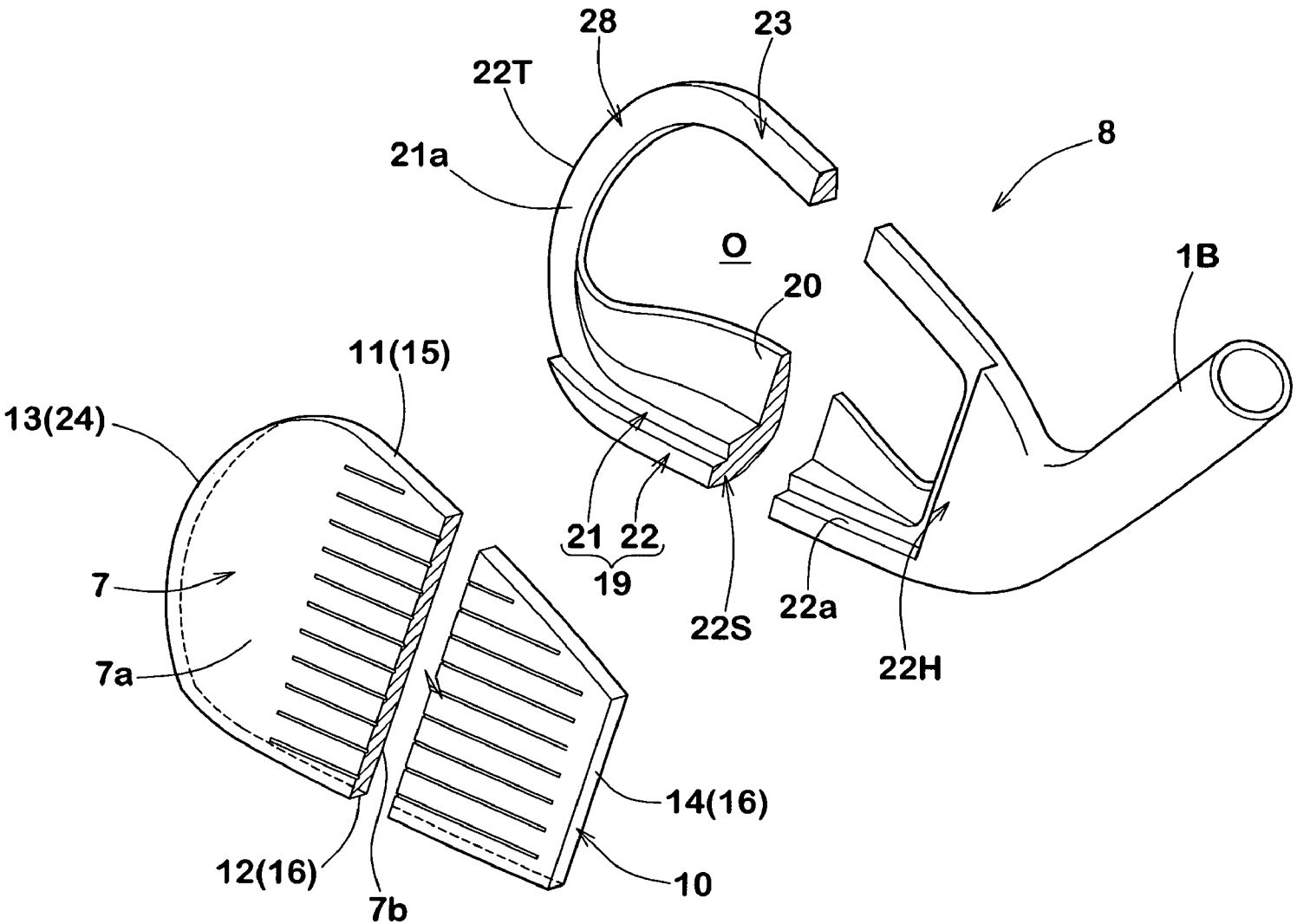
FIG. 9 is an exploded perspective view of the club head of FIG. 7.

A further embodiment of the present invention is shown in FIGS. 7 to 9, in which a toe side exposed portion 24 which extends to the toe face 5 to constitute a part of the toe face 5 is provided in at least a part of the toe side edge surface 13 of the face plate 7. In this embodiment, of the toe side edge surface 13, a large portion ranging from its upper end to a neighborhood of its lower end is formed as a toe side exposed portion 24. The toe side exposed portion 24 is continuous with the upper exposed portion 15. On the other hand, lower edge surface 12 and heel side edge surface 14 of the face plate 7 are the same as those in the previous embodiments.

The outer wall portion 22 of the head body 8 is provided with a toe side broken portion 28 for causing the toe side exposed portion 24 of the face plate 7 to expose on the toe 5 as well as the upper broken portion 23. The toe side broken portion 28 is continuous with the upper broken portion 23. The toe side broken portion 28 is a portion which has been removed from the outer wall portion 22 on its toe side in a length corresponding to the length of the toe side exposed portion 24. Therefore, at the toe side broken portion 28, the receiving portion 21 extends up to the toe face 5, and toe side edge surface 31 of the receiving portion 21 forms a rear portion of the toe 5 while the toe side exposed portion 24 of the face plate 7 forms a front portion of the toe 5. At the toe face 5, welding is performed along a boundary line L5 between the toe side exposed portion of the face plate 7 and the toe side edge surface 31 of the head body 8.

According to such a club head 1, the weight of an upper portion of the head is reduced also on the toe side and, therefore, it is possible to further lower the center of gravity. Further, the weight reduced on the toe side can be utilized for increasing the area of the face 2.

Figure 10:
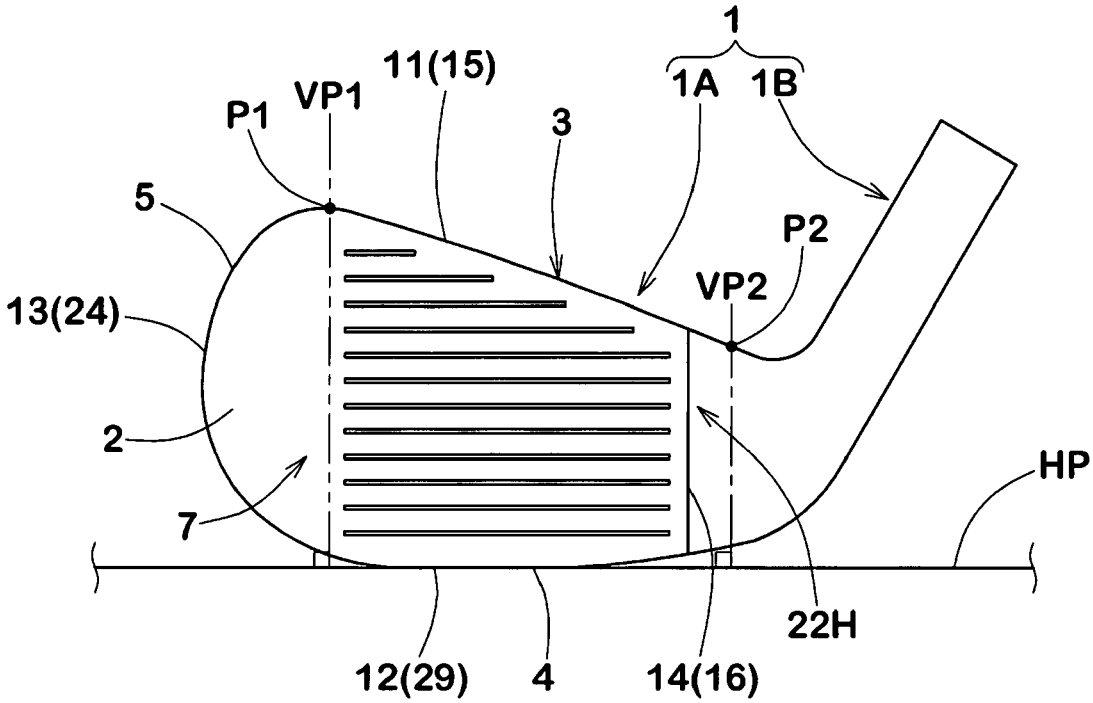
FIG. 10 is a front view of an iron-type golf club head showing still another embodiment of the present invention.
Figure 11:
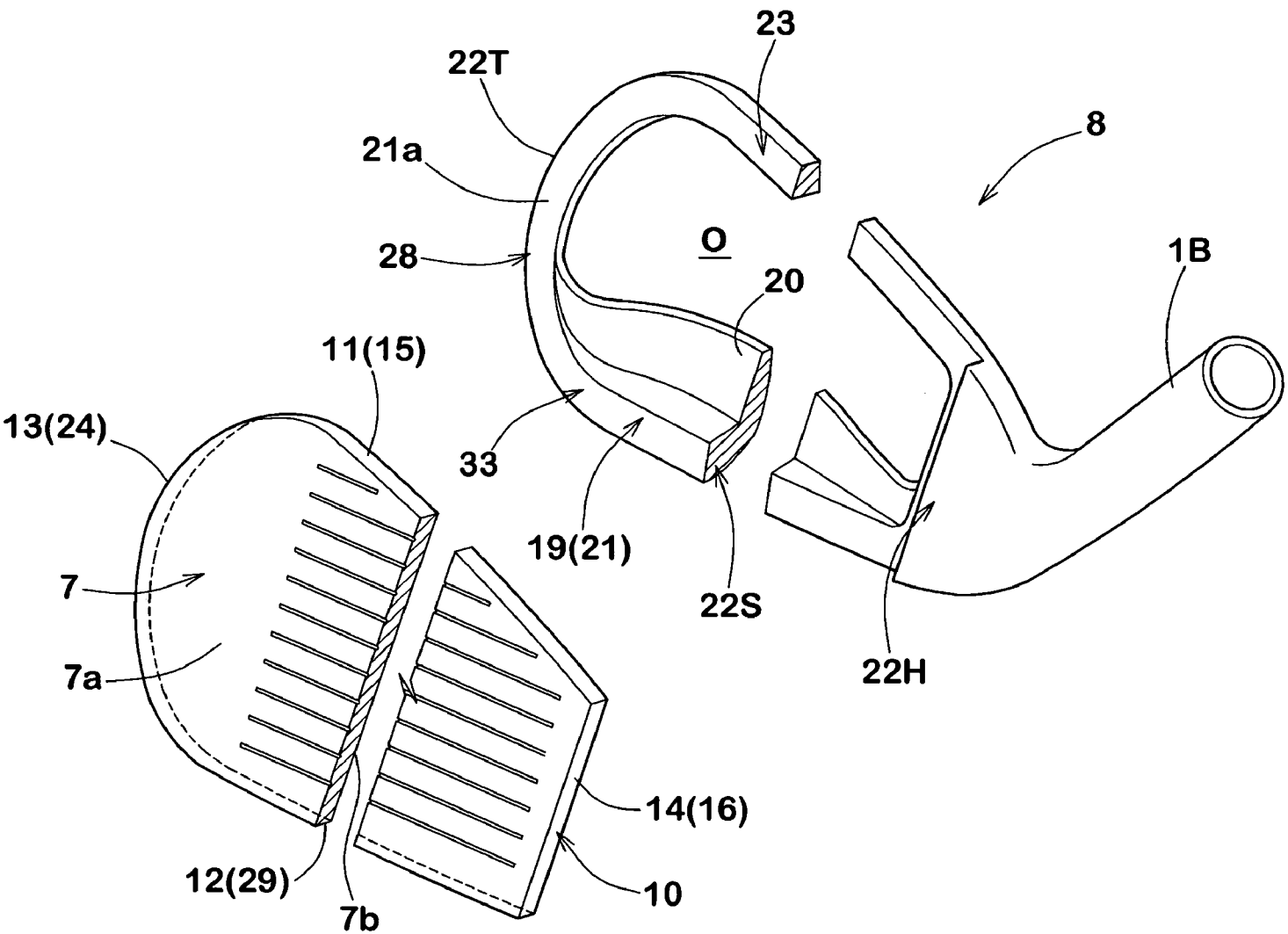
FIG. 11 is an exploded perspective view of the club head of FIG. 10.

Another embodiment of the present invention is also shown in FIGS. 10 and 11, in which a lower exposed portion 29 which extends to the sole face 4 to constitute a part of the sole face 5 is provided in at least a part of the lower edge surface 12 of the face plate 7 as well as the top side and toe side exposed portions 15 and 24. That is to say, in this embodiment, the upper edge surface 11, the lower edge surface 12 and the toe side edge surface of the face plate 7 are exposed to the top face 3, the sole face 4 and the toe face 5, respectively, to give the is exposed portions 15, 24 and 29.

In accordance with this structure, upper (top side) broken portion 23, toe side broken portion 28 and sole side broken portion 33 are continuously provided in the outer wall portion 22 of the head body 8 in order to expose the top side, toe side and sole side exposed portions 15, 24 and 29 to the outer surface of the head, respectively. According to such a club head 1, the weight of the head is reduced at top 3, toe 5 and sole 4 and, therefore, the weight margin obtained thereby can be effectively utilized for increasing the area of the club face 2, and the like. The face plate 7 is welded to the head body 8 at the top face 3, the sole face 5 and the toe face 6, excepting the heel side edge surface 14.

While preferable embodiments of the present invention have been described with reference to the drawings, it goes without saying that the present invention is not limited to only such embodiments and various changes and modifications may be made.

The present invention is more specifically described and explained by means of the following Examples and Comparative Examples. It is to be understood that the present invention is not limited to these Examples.

EXAMPLES 1 TO 5 AND COMPARATIVE EXAMPLES 1 TO 3

Iron-type golf club heads (5-iron, loft angle 26°, lie angle 60.5°) were produced based on the specifications shown in Table 2, and the performances described below were measured for each of the club heads. In these Examples, the alloy A shown in Table 1 (Fe/Al/Mn/C=69.5/10/20/0.5% by weight, specific gravity 6.8) was used for the face plate, excepting Comparative Example 2. The face plate of Comparative Example 2 was produced from carbon steel S25C (specific gravity 7.9). All head bodies were produced from carbon steel S25C by forging.

(1) Height of Center of Gravity

The vertical height of the sweet spot from the horizontal plane was measured in the standard state. The smaller the value, the lower the center of gravity.

(2) Hitting Feel

A shaft made of a carbon fiber-reinforced resin ("MP-400" shaft made by SRI Sports Limited) was attached to each of the club heads to give an iron-type golf club. Each of seven golfers hit 5 three piece golf balls (trade mark "XXIO", product of SRI Sports Limited) with each golf club. The feel of hitting golf balls was evaluated according to the following 1-5 rating scales with respect to softness and clear response of ball hitting. The results are shown by an average value. The larger the value, the better the feel of hitting ball.

5: Very good
4: Good
3: Indifferent
2: Bad
1: Very bad (3) Ball Controllability

Using each of the above-mentioned iron-type golf clubs, each of seven golfers hit 5 three-piece golf balls (trade mark "XXIO", product of SRI Sports Limited) in the same manner as above. With respect of easiness in lifting a ball (the more easily a ball lifts, the better) and ball stopping state (the more easily a hit ball stops after falling, the better), evaluation was made by the same 5-point method as above. The results are shown by an average value. The larger the value, the better the ball controllability.

(4) Delivery Angle

Each golf club was attached to a swing robot (made by True Temper Sports, Inc.) and hit five golf balls per club at a head speed of 40 m/s, and the delivery angle of hit ball was measured with respect to the horizontal plane. Evaluation was made on the average value. The larger the value, the more easily the ball is lofted and accordingly the better.

(5) Productivity

Productivity A: With respect to each club head, a face plate was temporality fit to a prescribed position of a head body, and the both members were welded together. The time up to producing 20 club heads was measured. The results are shown as an index based on the result of Example 1 regarded as 100. The smaller the value, the better the productivity.

Productivity B: The appearance of produced club heads was visually observed, and the number of defective heads that a face plate and a head body were welded together with being out of position was counted. The smaller the value, the better the productivity.

The results are shown in Table 2.

From the results shown in Table 2, it is observed that the club heads of the Examples according to the present invention have a low center of gravity as compared with those of the Comparative Examples and, based thereon, have an improved ball controllability. It is also observed that the productivity-is not deteriorated.

TABLE 2

Figure 12A:
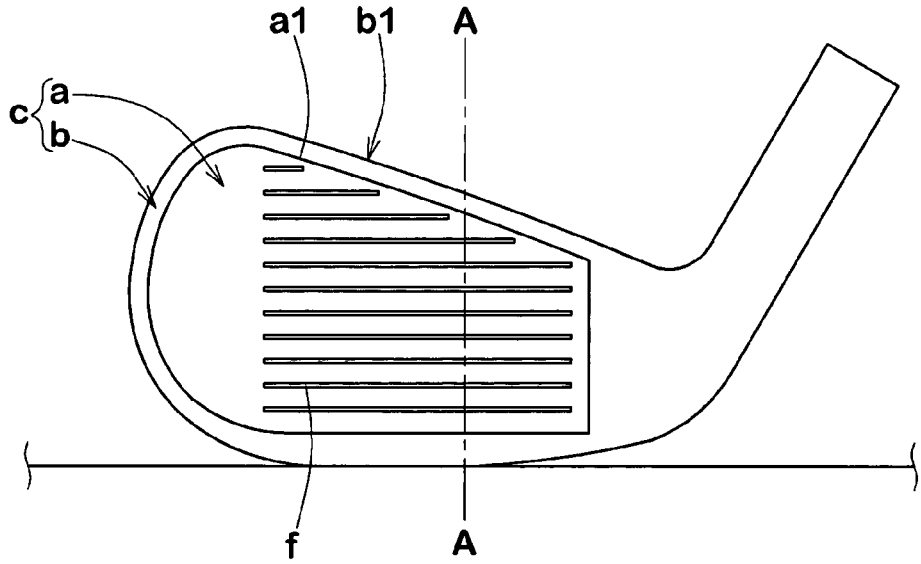
FIG.12(a) PRIOR ART
FIG. 12(*a*) is a front view of a conventional iron-type golf club head.
Figure 12B:
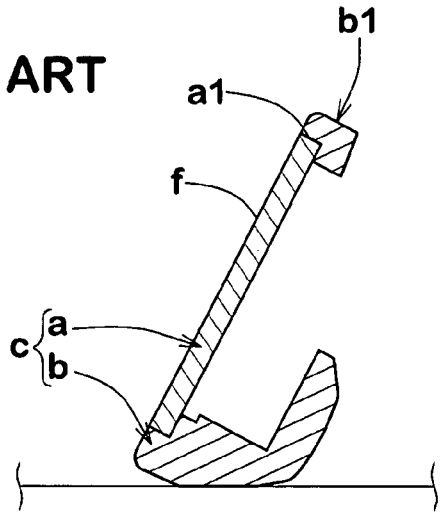
FIG.12(b) PRIOR ART

| | Ex. 1 | Ex. 2 | Com. Ex. 1 | Ex. 3 | Com. Ex. 2 | Ex. 4 | Ex. 5 | Com. Ex. 3 |
|---|---|---|---|---|---|---|---|---|
| Type of head | FIG. 1 | FIG. 7 | FIG. 12 | FIG. 10 | FIG. 1 | FIG. 6 | FIG. 7 | FIG. 1 |
| Face plate | | | | | | | | |
| Material | Fe—Al alloy | Fe—Al alloy | Fe—Al alloy | Fe—Al alloy | S25C | Fe—Al alloy | Fe—Al alloy | Fe—Al alloy |
| Specific gravity | 6.8 | 6.8 | 6.8 | 6.8 | 7.9 | 6.8 | 6.8 | 6.8 |
| Method of production | rolling | rolling | rolling | rolling | rolling | forging | forging | casting |
| Head body | | | | | | | | |
| Material | S25C | S25C | S25C | S25C | S25C | S25C | S25C | S25C |
| Specific gravity | 7.9 | 7.9 | 7.9 | 7.9 | 7.9 | 7.9 | 7.9 | 7.9 |
| Method of production | forging | forging | forging | forging | forging | forging | forging | forging |
| Results | | | | | | | | |
| Height of center of gravity (mm) | 20.0 | 19.6 | 21.0 | 20.1 | 21.3 | 19.8 | 19.6 | 20.0 |
| Whole weight of head (g) | 255 | 255 | 255 | 255 | 267 | 255 | 255 | 255 |
| Hitting feel (1-5 ratings) | 4.6 | 4.6 | 4.4 | 4.6 | 4.7 | 4.6 | 4.6 | 3.5 |
| Ball controllability (1-5 ratings) | 4.3 | 4.4 | 2.4 | 4.0 | 1.9 | 4.4 | 4.4 | 4.3 |
| Delivery angle (degree) | 17.5 | 17.9 | 16.8 | 17.4 | 16.5 | 17.7 | 17.9 | 17.5 |
| Productivity A | 100 | 105 | 100 | 113 | 100 | 100 | 105 | 100 |
| Productivity B | 0 | 1 | 0 | 3 | 0 | 0 | 1 | 0 |

What is claimed is:

1. An iron-type golf club head having a top forming an upper surface of the club head, a sole forming a bottom surface of the club head, and a toe connecting the top and the sole on a toe side of the club head, and comprising, at least, a face plate whose front surface forms at least a part of a club face for hitting a golf ball, and a head body to which the face plate is attached;

wherein the face plate is formed by forging or rolling an iron alloy having a specific gravity of 6.6 to 7.2 and containing at least 50% by weight of Fe and 5 to 15% by weight of Al, and the head body is made from a low carbon steel having a carbon content of less than 0.3% by weight which is weldable with the face plate and having a larger specific gravity than the face plate, and wherein the face plate has an upper edge surface located on the top side, a lower edge surface located on the sole side, and an outer peripheral edge surface including a toe side edge surface connecting the upper edge surface and the lower edge surface, and the face plate is welded to the head body and extends to the top so that at least a part of the upper edge surface includes an upper exposed portion which constitutes a part of the top, the head body comprises an opening which passes through back and forth, a face mount portion for fitting the face plate thereto which is disposed in the periphery of the opening, a back wall portion which is disposed behind the face mount portion to form a cavity in a pocket form between it and the back face of the face plate, and a hosel, in which the face mount portion includes a receiving portion which is depressed from the face and supports a peripheral edge portion of the back face of the face plate and which has a continuous annular form surrounding the opening to thereby annularly and continuously support the peripheral edge portion of the back face of the face plate, and an outer wall portion which rises from the peripheral edge of the receiving portion and supports the outer peripheral edge surface of the face plate and which has an upper broken portion for causing the upper exposed portion of the face plate to be exposed at the top, the receiving portion having a width WU (measured from the edge of the opening in the direction perpendicular to the edge) of 2 to 8 mm, and the face plate extends toward both the sole and toe sides and terminates before the sole face and the toe face without the lower edge surface and toe side edge surface thereof contacting the sole face and the toe face, the head body includes a sole side outer wall portion and a toe side outer wall portion for supporting the lower edge surface and the toe side edge surface, the lower edge surface of the face plate and the sole side outer wall portion of the head body are welded together on the club face, and the toe side edge surface of the face plate and the toe side outer wall portion of the head body are welded together on the club face, in which the Ws/Wt ratio of the width Ws of the sole side outer wall portion to the width Wt of the toe side outer wall portion is from 1.2 to 2.0.

2. The golf club head of claim 1, wherein the face plate extends to the toe so that at least a part of the toe side edge surface includes an toe side exposed portion which constitutes a part of the toe, the outer wall portion of the head body has a toe side broken portion which allows for the toe side exposed portion to be exposed at the top, and the toe side exposed portion is welded to the head body on the toe face.

3. The golf club head of claim 1, wherein the upper exposed portion and the head body are welded together on the top face.

4. The golf club head of claim 1, wherein the head body is formed by forging.

5. The golf club head of claim 1, wherein the face plate has a rib which extends along the upper edge surface of the face plate and projects toward the back, and a dent portion for setting the rib therein is provided in the receiving face at a location corresponding to the upper broken portion of the head body.

6. The golf club head of claim 5, wherein the rib is formed so that the width "tu" of the upper edge surface of the face plate is larger than the width "tf" of the other edge surfaces.

7. The golf club head of claim 1, wherein the height of the center of gravity which is defined as a height from the horizontal plane of the sweet spot SS which is a point where a normal line drawn to the club face from the center of gravity of the club head intersects the club face, is from 15.0 to 21.0 mm.

8. The golf club head of claim 1, wherein the back wall portion extends upwardly from the sole and has such a height that it increases from the toe and heel sides toward the center of the back wall portion.

* * * * *